US005617977A

United States Patent [19]

Augustinus

[11] Patent Number: 5,617,977

[45] Date of Patent: Apr. 8, 1997

[54] DISPENSER HEAD FOR DISPENSING A LIQUID WHICH IS PRESSURIZED BY A GAS IN A CONTAINER

[75] Inventor: Per K. Augustinus, Odense, Denmark

[73] Assignee: Micro Matic A/S, Odense, Denmark

[21] Appl. No.: 464,744

[22] PCT Filed: Oct. 17, 1994

[86] PCT No.: PCT/DK94/00386

§ 371 Date: Jun. 27, 1995

§ 102(e) Date: Jun. 27, 1995

[87] PCT Pub. No.: WO95/11191

PCT Pub. Date: Apr. 27, 1995

[30] Foreign Application Priority Data

Oct. 22, 1993 [DK] Denmark ..... 1192/93

[51] Int. Cl.[6] ..... B65D 83/14

[52] U.S. Cl. ..... 222/400.7

[58] Field of Search ..... 222/341, 400.7, 222/400.8

[56] References Cited

U.S. PATENT DOCUMENTS

| | | | |
|---|---|---|---|
| 3,758,008 | 9/1973 | Johnston | 222/400.7 |
| 4,450,853 | 5/1984 | Dessenoix et al. | 222/400.7 X |
| 4,516,698 | 5/1985 | Cerrato | 222/341 |
| 4,612,952 | 9/1986 | Fallon | 222/400.7 X |

FOREIGN PATENT DOCUMENTS

| | | |
|---|---|---|
| 145414 | 11/1982 | Denmark . |
| 0294095 | 12/1988 | European Pat. Off. . |
| 4316457 | 10/1994 | Germany . |
| WO9317954 | 9/1993 | WIPO . |

*Primary Examiner*—Jospeh Kaufman
*Attorney, Agent, or Firm*—Nixon & Vanderhye

[57] ABSTRACT

A dispenser head serves to dispense a liquid which is pressurized by gas in a container having a valve. The dispenser head comprises a housing with a gas chamber and a tubular slide which can be moved up and down for opening and closing the valve. With a view to facilitating dismounting of the dispensing head when the container is empty, the wall of the housing is formed with a first gas channel which extends upwards from the gas chamber to a mouth. The slide is moreover formed with an annular groove communicating with said mouth in the upper slide position and via a second gas channel with the atmosphere. The positive pressure in the gas chamber is thereby relieved immediately when the slide is pulled up to close the valve, and the dispenser head can therefore be pulled clear of the valve flange easily and conveniently in the dismounting operation.

10 Claims, 4 Drawing Sheets

DISPENSER HEAD FOR DISPENSING A LIQUID WHICH IS PRESSURIZED BY A GAS IN A CONTAINER

BACKGROUND OF THE INVENTION

The invention concerns a dispenser head for dispensing a liquid which is pressurized by a gas in a container having a valve, said dispenser head comprising a housing which can be detachably mounted on the valve; a seal to form a tight connection between the housing and the valve; a gas chamber which is provided in the housing and is defined downwardly by the valve in the mounted state of said housing; a gas connection terminating in a central hole which extends vertically upwards in the housing from the gas chamber to the atmosphere; a tubular slide arranged in the central hole and slidable up and down between upper and lower positions by means of a hand grip, said slide opening the valve in the lower position such that the interior of the slide communicates with the liquid of the container and the gas chamber with the gas of the container.

Today it is very popular to distribute beverages, such as beer, wine, mineral water and soft drinks, in transportable containers, which are then commonly called kegs.

The pressure gas used is generally $CO_2$, which both serves as a propellant gas in connection with the dispensing and as a means to impart to the respective beverage a characteristic sparkling and effervescent consistency.

The gas is added from e.g. a gas bottle which is connected with the gas inlet of the dispenser head by means of a hose or a tube. The gas penetrates from the gas chamber of the dispenser head further into the container via a gas passage in the valve when the valve is open, and the beverage can now be dispensed under the action of the gas pressure via a liquid passage in the valve and the tubular slide by opening a tap, which is connected with the upper end of the slide via a hose or a tube. When the container has been emptied, the empty container is to be returned to the supplier to be filled again.

However, the dispenser head has to be removed beforehand. At this time, however, the gas chamber is still under full gas pressure, even though the valve of the gas bottle is closed, and the gas chamber is therefore sealed from the surroundings.

The gas pressures used for e.g. soft drinks, such as Coca Cola, are frequently rather great, e.g. about 4 bars. These great pressures cause the main seal to be pressed hard down against the valve flange and to be retained on it against displacement in the plane of the flange with a considerable frictional force. It is necessary to overcome this frictional force if the dispenser head is to be capable of being pulled clear of the valve flange for removal. In conventional dispenser heads this operation will therefore be both cumbersome and strenuous and necessitate that the operator puts a great deal of effort into the performance of the operation.

Accordingly, there is a need for a dispenser head of the type mentioned in the opening paragraph which can be pulled clear of the valve flange easily and conveniently in the dismounting operation.

SUMMARY OF THE PRESENT INVEENTION

This object is obtained according to the invention in that the wall of the housing is provided with a first gas channel extending upwards from the gas chamber to a mouth in the central hole; that the slide is formed with an annular groove which, in the upper slide position, communicates with this mouth and via a second gas channel with the atmosphere; and that the mouth is blocked by the slide in the lower position of the slide. This structure ensures that the pressure in the gas chamber is relieved via the connection which is now automatically formed to the atmosphere when the slide is lifted up to its upper position. Then, the main seal is no longer pressure loaded when the dispenser head is to be pulled clear of the flange in the dismounting operation. The dismounting operation can therefore be performed without any form of difficulty.

The first gas channel may expediently be formed by a through hole which extends outwardly from the gas chamber to a mouth in the central hole, and the second gas channel by a passage in the housing from the atmosphere to the groove in the slide when the slide is present in its upper position.

Axial sealing between the slide and the wall of the central hole is advantageously provided by means of sealing rings which are embedded in grooves in the wall. The connection between the first and the second gas channels is then established since the groove in the slide in the upper position thereof extends from the mouth of the first gas channel to the second gas channel, while the sealing ring arranged below the mouth of the first gas channel is in intimate contact with the slide section below the groove. In the lower position of the slide, the section above its groove will be in intimate contact with both the sealing ring below the mouth of the first gas channel and a sealing ring above this mouth. This interrupts the connection between the first and the second sealing rings, and the keg is now operational.

When the dispenser is to be dismounted, the valve of the gas bottle may be closed to stop the gas flow through the dispenser head when the slide is lifted and the dispenser head is then removed from the valve.

As a safeguard against continuous outflow of the gas through the dispenser head, if the gas valve does not close or does not close sufficiently tightly, a sealing ring to seal the slide in its upper slide position may be provided in a groove in the wall of the central hole between the mouth of the gas inlet and the gas chamber. The connection between the gas chamber and the gas bottle is then blocked automatically when the slide is lifted. This connection can be established again by means of another groove in the slide when the slide is moved down to its lower position, said other groove being formed such as to extend between the gas chamber and the mouth of the gas connection in the central hole.

The invention will be explained more fully by the following description of embodiments, which just serve as examples, with reference to the drawing, in which

BRIEF DESCRIPTION OF THE DRAWING FIGURES

FIG. 1 is a partially sectional view of a dispenser head according to the invention mounted on the valve on a keg, with the slide in the upper position, FIG. 2 is a view of the same, but with the slide in the lower position, FIG. 3 is an enlarged view of the dispenser housing with a first embodiment of a first gas channel for evacuating the gas pressure in the housing of the dispenser head during dismounting, FIG. 4 is a view of the same, but with a second embodiment of the first gas channel, FIG. 5 shows an enlarged fraction of the housing with a first embodiment of a second gas channel for evacuating the gas pressure in the housing of the dispenser head during dismounting, FIG. 6 is a view of the same, but with a second embodiment of the second gas channel, FIGS. 7*a* and *b* show the same, but with a third embodiment of the second gas channel, and with the slide in the upper position and the lower position, respectively.

DESCRIPTION OF A PREFERRED EMBODIMENT

Figure 1:
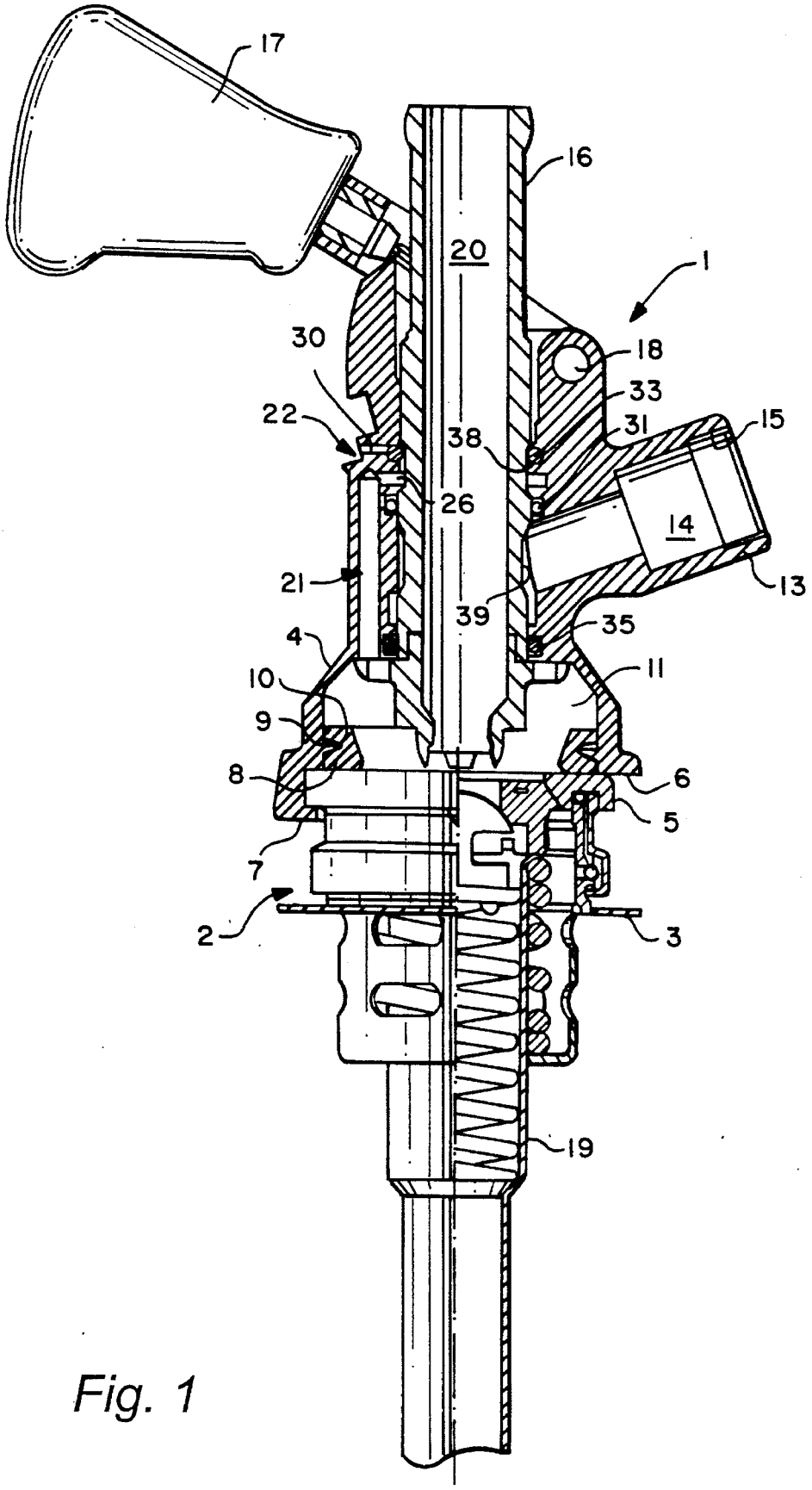
Figure 2:
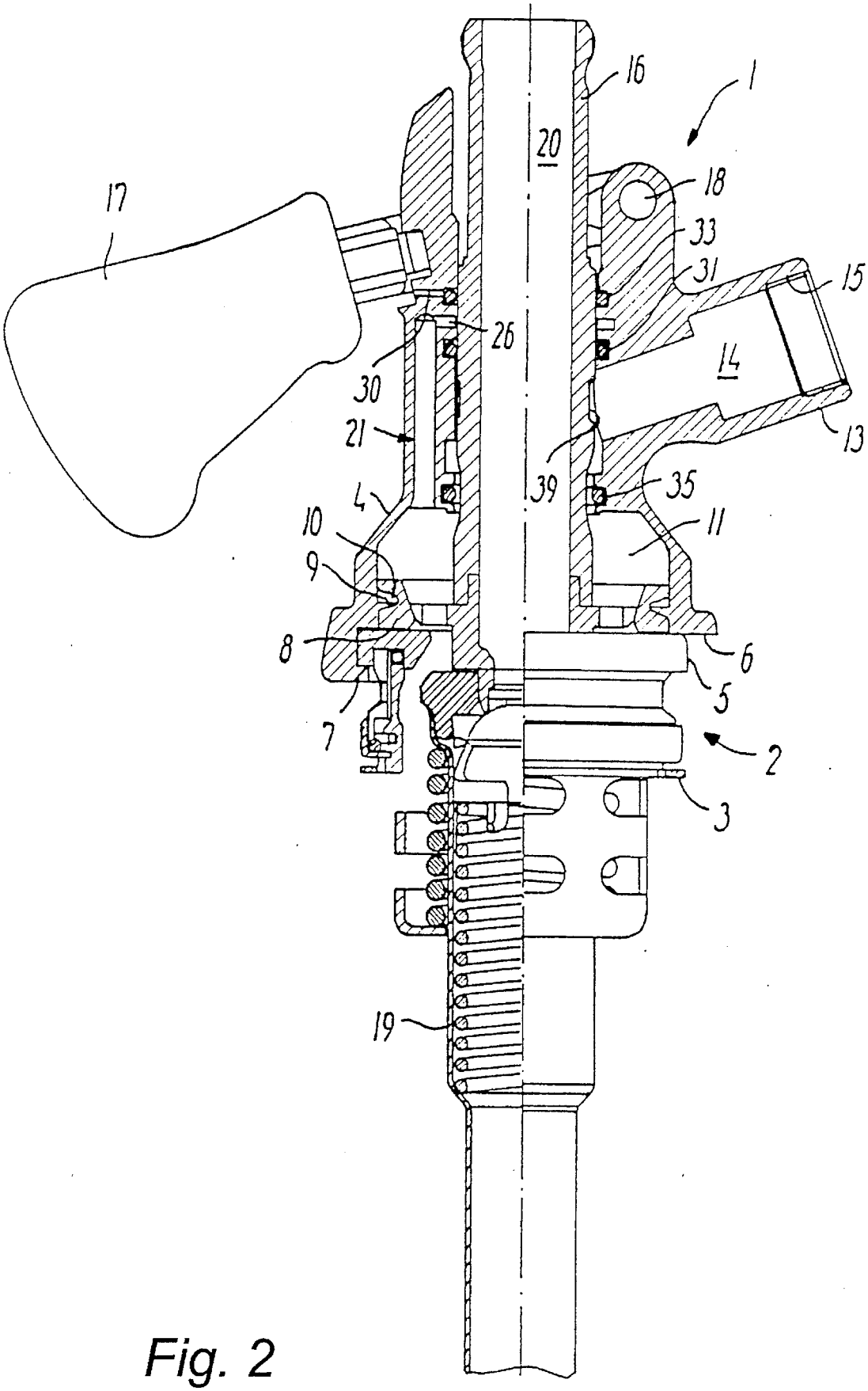

In FIGS. 1 and 2 the dispenser head is generally designated by the reference numeral 1. The dispenser head is mounted on a valve 2 in a transportable container or keg 3, only a fraction of which being shown in the figure. The valve is a double valve which has both a gas passage and a liquid passage. The valve is of a conventional type and will therefore not be described in detail here.

The dispenser head comprises a housing 4 which can be moved laterally inwardly over an upper flange 5 on the valve. For this purpose the housing has an engagement face 6 which, in the mounted state of the housing, engages the upper side of the flange 5, and a semi-open collar 7 which simultaneously engages the underside of an area along the periphery of the flange 5. A main seal 8 serves to form a seal between the housing and the valve. In the shown case the main seal is kept in position in the housing by means of an annular rib 9, which engages an annular groove 10 in the main seal 8.

The main seal 8 is arranged in a gas chamber 11 which is provided in the housing and is downwardly defined by the valve flange when the housing is mounted on the valve flange.

Figure 4:
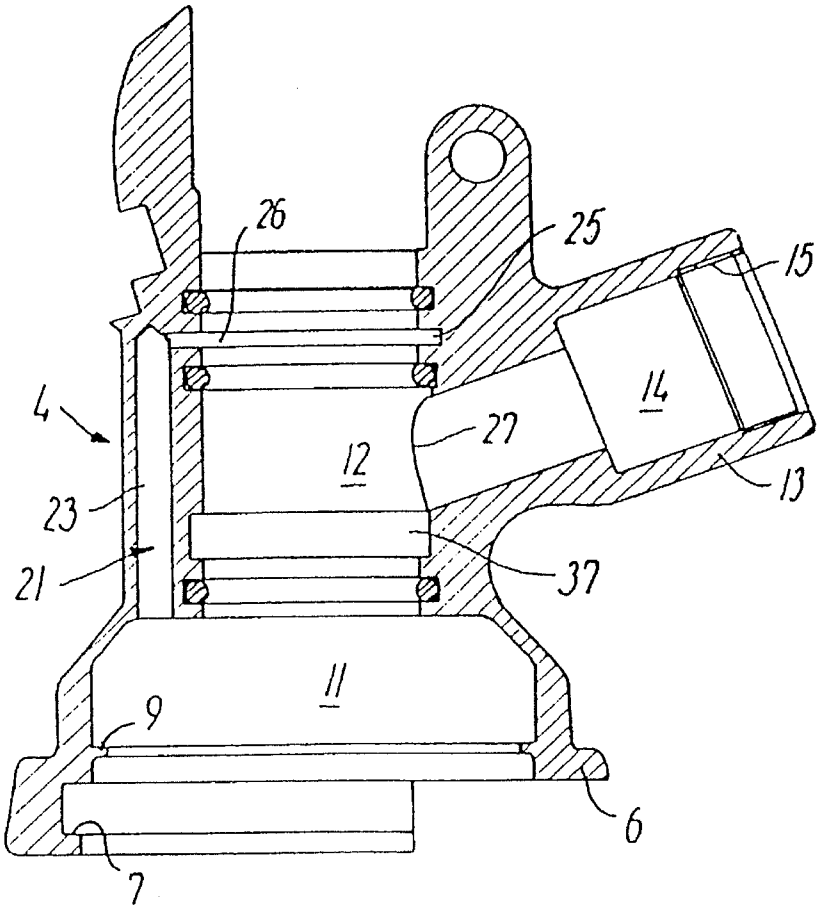
Figure 3:
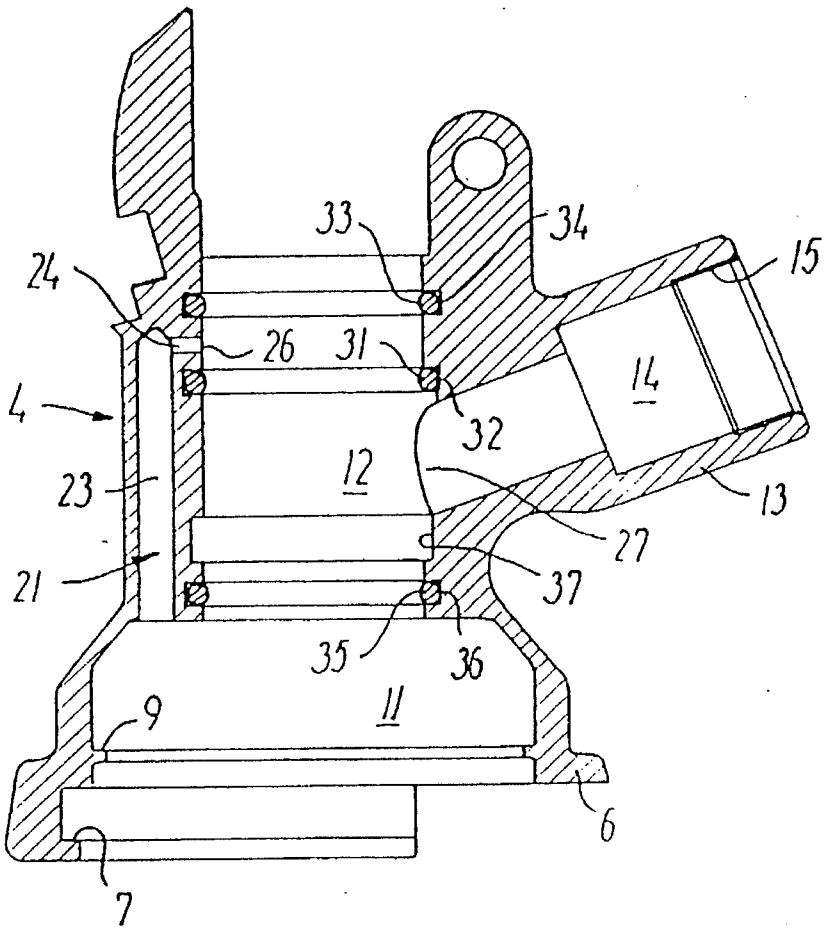

The housing, which is shown in an enlarged view in FIGS. 3 and 4, moreover has a central hole 12 which extends vertically between the gas chamber 11 and the atmosphere. In this context "vertical" means the orientation shown in the drawing. In practice,.however, the dispenser head may be oriented in another manner, e.g. have a position in which the axis of the central hole forms an angle with the vertical.

The housing is formed with a stub 13 having a gas connection 14 in the form of a through hole terminating in the central hole 12. Threads 15 in the stub serve to connect the stub with a high pressure bottle (not shown) for $CO_2$by means of a tube or a hose (not shown).

The central hole 12 accommodates a tubular slide 16 which can be moved up and down between upper and lower positions by means of a hand grip 17, which is pivotally mounted on a pivot in the housing. When the hand grip is pressed down or lifted, it brings along the slide in a manner known per se, which will therefore not be described more fully here.

In the lower position the slide 16 opens the valve 2 by means of its lower end part adapted for the purpose, said valve 2 being a double valve having both a gas passage and a liquid passage. The space above the container can then be filled or topped with gas via the gas passage in the valve, the gas chamber 11, the gas connection 14 and its communication with the gas bottle. The gas, which will normally be $CO_2$, serves as a propellant gas which tries to press the liquid out of the liquid passage of the valve via a down pipe 19 on the valve 2. This takes place by means of a tap (not shown) which is connected with the upper end of the slide 16 by means of a tube or a hose (not shown), such that the liquid from the liquid passage of the valve 2 flows through the hole 20 in the slide to the tap via its connection with the slide. This operation generally takes place each time e.g. a glass of draught beer or soft drinks are dispensed in a restaurant or a similar establishment.

In addition to serving as a propellant gas, the added $CO_2$also serves to impart to the beverage in the keg a desired sparkling and effervescent consistency. Some beverages require a relatively high $CO_2$ pressure for the liquid to be capable of absorbing the amount of $CO_2$ which is prescribed by the supplier. An example is Coca Cola with a $CO_2$ pressure of about 4 bars.

When the keg is empty, the dispenser head is to be pulled laterally clear of the valve flange 5 for the keg to be returned as an empty container to the supplier. However, in conventional dispenser heads of this type the dispenser head is kept fixed on the valve flange by the considerable pressure in the gas chamber. This pressure urges the main seal 8 down against the upper side of the valve flange and the collar 7 up against its underside. When the positive pressure is as great as 4 bars, release of the dispenser head from the valve therefore requires an even very strong pull. Of course, this work is cumbersome and strenuous and must frequently take place in restricted space when the keg is placed e.g. in a compartment below a bar in a restaurant. The operation moreover involves a certain physical risk to the operator, who will tend to exert all his strength when pulling the valve, which will let off without warning and suddenly when at a certain time the gas chamber communicates with the ambient atmosphere and the gas is ejected from the chamber. The operator may be injured during this by losing his balance or in that the arm by means of which the operator pulls the dispenser head continues its movement at full speed into an adjacent object.

The invention is intended to remedy this very serious drawback of the conventional valves. This takes place by the arrangement of the dispenser head which is described below.

A first gas channel 21 and a second gas channel 22 are provided in the wall of the dispenser housing 4.

FIG. 3 shows a first embodiment of the first gas channel 21. This gas channel consists of a blind hole 23 which is drilled into the wall of the housing 4 from the gas chamber 11. A transverse hole 24 leads into the central hole 12 from the blind end of the blind hole.

FIG. 4 shows a second embodiment of the first gas channel 21. This embodiment is quite similar to the embodiment of FIG. 3, except that the transverse hole 24 has been replaced by an annular groove 25, which is provided in the wall of the central hole 12 and extends depthwise to intersect the blind hole 23. In both cases the first gas channel 21 has a mouth 26 which is vertically spaced above the mouth 27 of the gas connection 14 in the central hole 12.

Figures 5, 6, 7A, 7B:
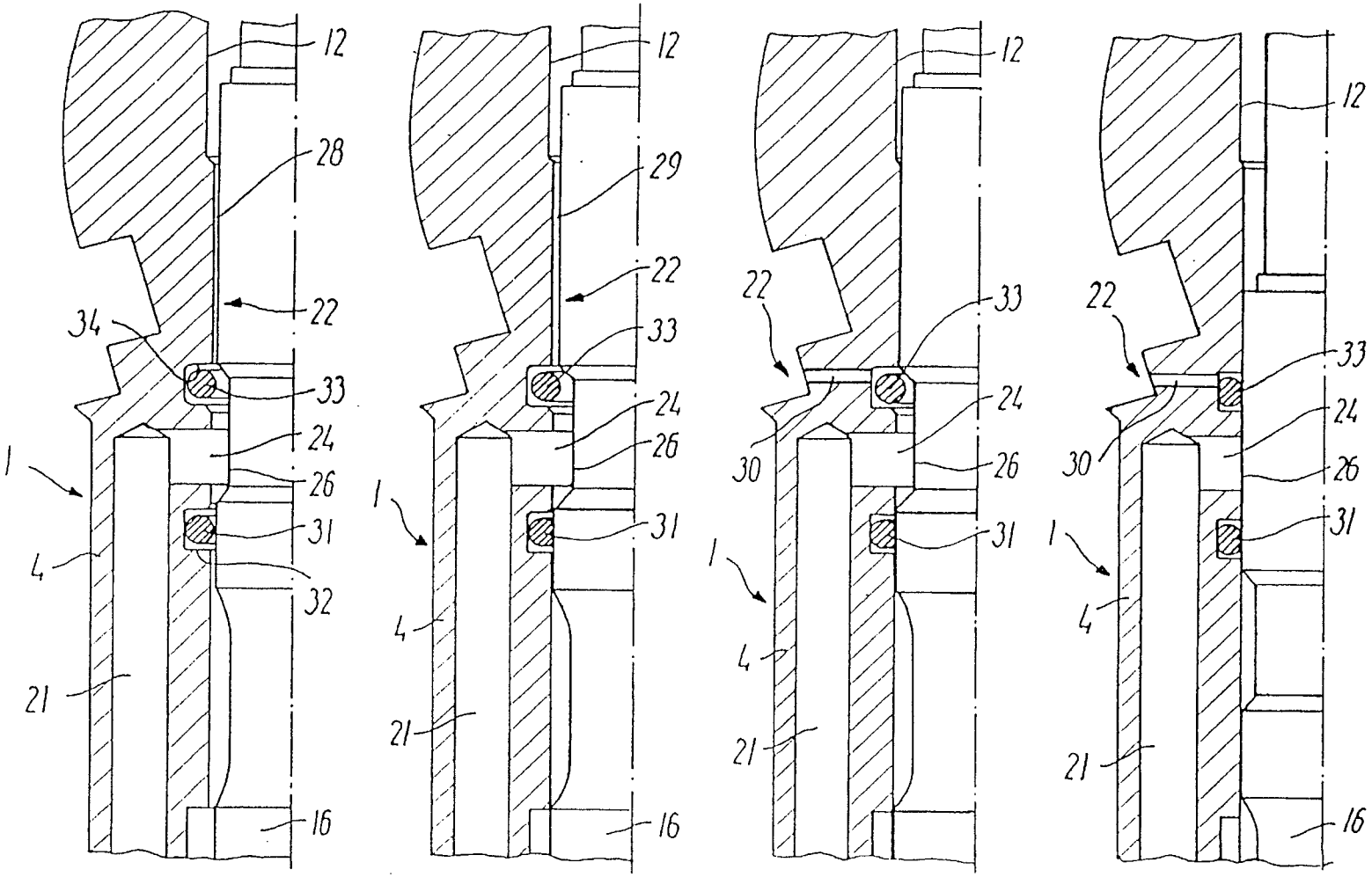

The arrangement of the second gas channel 22 is shown best in FIGS. 5, 6 as well as FIGS. 7*a* and *b*. FIG. 5 shows a first embodiment of the second gas channel 22. In this case the second gas channel, as shown, merely consists of a slot 28 between an upper part of the housing 4 and an upper part of the slide 16. This means that the housing has a slightly greater diameter than the slide at this point.

FIG. 6 shows a second embodiment of the second gas channel, in which the housing and the slide do not have to differ in diameter, since the second gas channel consists of one or more longitudinal grooves 29 which are provided at this point in the wall of the central hole 12.

Finally, FIGS. 7*a* and 7*b* show a third embodiment of the second gas channel which, in this case, consists of one or more transverse holes 30 drilled from the outside transversely through the wall of the housing to the central hole 12. FIG. 7*a* shows the slide in the upper position and FIG. 7*b* in the lower position.

For efficient axial sealing between the slide and the wall of the central hole, said wall is formed with three O-ring grooves to receive their respective O-rings. A first O-ring 31 is embedded in a first O-ring groove 32 between the mouth 27 of the gas connection 14 and the mouth 26 of the first gas channel 21. A second O-ring 33 is embedded in a second O-ring groove 34 which is present above the mouth 26 of the first gas channel 21. A third O-ring 35 is embedded in a third O-ring groove 36 between the mouth 27 of the gas connection 14 and the gas chamber 11. The central hole 12 has an expansion 37, which extends up to the mouth 27 of the gas connection 14, in an area above the O-ring 35.

Further, two annular grooves 38, 39 are provided in the slide 16. The groove 38 is vertically spaced above the groove 39.

The mutual location of the above-mentioned structural elements, of which the dispenser head of the invention is composed, is of decisive importance for the function which is to make it easier to dismount the dispenser head than is the case with the conventional dispenser heads. This function is understood best by considering FIGS. 1 and 2 as well as FIGS. 7*a* and *b*. These figures show the embodiment of the first gas channel 21 which has a transverse hole 24, and the embodiment of the second gas channel 22 which has a transverse hole 30. FIG. 2 and FIG. 7*b*, in which the slide 16 is in the lower position, are considered first. In this position, the first and the second O-rings 31, 33 are in intimate contact with the slide 16. This blocks the mouth 26 of the first gas channel 21 in the central hole 12 and also prevents axial discharge of Gas to the atmosphere from the gas connection 14. Further, the second Groove 39 of the slide extends from the gas connection 14 or the expansion 37 of the central hole past the third O-ring 35 down to the gas chamber 11, such that this is now in gas communication with the gas connection 14.

The extent and location of the second groove 39 on the slide 16 in connection with the circumstance that the central hole 12 with the expansion 37 expands at a short distance above the gas chamber 11, causes the gas communication to the gas chamber to be opened at a very early time during the downward travel of the slide 16.

In the conventional dispenser heads, during the opening movement of the slide, the lower O-ring has tended to be pressed out of its O-ring groove by the pressure difference over the O-ring before the gas pressure in the gas chamber has been built up. The O-ring can hereby become squeezed between the housing 4 and the slide 16 and block the gas flow to the gas chamber 11 and thereby to the keg 3.

This serious drawback of the conventional dispenser heads has been remedied according to the invention by the above-mentioned arrangement of the housing and the slide, the gas communication to the gas chamber 11 being now opened so early that the pressure difference over the lower O-ring 35 is equalized before the O-ring has been pressed out of its O-ring groove 36.

As will be seen best from FIG. 1, the end part of the slide 16 is present at such a great distance above the valve 2 in the upper slide position according to the invention that said early opening of the gas communication to the gas chamber 11 takes place before the valve opens. The gas pressure rapidly built up in the gas chamber then presses the main seal 8 down into intimate contact with the valve flange 5, thereby obviating the drawback known from the conventional dispenser heads of annoying and un-hygienic splashing of gas and liquid past the main seal to the atmosphere during the opening of the keg.

The keg has now been made operational safely and without annoying side effects. The overall gas system is sealed completely from the surroundings, while the gas space above the liquid in the container is in open communication with the gas bottle via the gas passage of the now open valve, the gas chamber 11, the second groove 39 in the slide, the expansion 37 of the central hole, the gas connection 14 and the connection (not shown) between said connection 14 and the gas bottle (not shown). The liquid contents of the container can now be dispensed as desired, since the gas pressure above the liquid drives the liquid through the liquid passage of the valve and the through hole 20 of the slide 16 via the connection (not shown) between the upper end of the slide and the tap (not shown) when this is opened.

When the keg is empty, the slide 16 is pulled up to the upper position shown in FIGS. 1 and 7*a* by operation of the hand grip 17. This closes both the gas passage and the liquid passage in the valve. The lower slide groove 39 is moved up over the third O-ring 35 which is thereby caused to sealingly engage the slide. The slide section above the lower slide groove 39 is moreover in sealing contact with the first O-ring 31. The gas connection 14 has now been blocked completely. The gas can neither penetrate down into the gas chamber 11 nor to the atmosphere, and the dispenser head can be removed from the valve 2 even though the gas bottle valve has not closed.

The upper slide groove 38 has simultaneously been moved up to a position in which it extends from a point between the first O-ring 31 and the mouth 26 of the first gas channel to a point which is located above the second O-ring 33 and communicates with the second gas channel 22 or the transverse hole 30 (FIG. 7*a*). A direct communication from the gas chamber 11 to the atmosphere has now been established via the first gas channel 21, the upper slide groove 38 and the second gas channel 22. The positive pressure in the gas chamber 11 is therefore relieved quickly when the slide is pulled up to its upper position.

The time it takes to equalize the pressure with that of the surroundings can be adapted by suitable calibration of the gas channels or the upper slide groove. The rate must be so great that dismounting is in no way delayed, without being so great that the ejecting gas makes considerable noise or is inconvenient to the surroundings.

As will appear, the dispenser head is now no longer fixed on the flange of the valve, and it can therefore be pulled clear of the flange with extreme ease.

I claim:

1. A dispenser head for dispensing a liquid which is pressurized by a gas in a container having a valve, said dispenser head comprising:

a housing which can be detachably mounted by being moved laterally over and into engagement with an upper flange of the valve;

a main seal to form a tight connection between the housing and the valve;

a gas chamber in said housing defined in part by the upper flange of the valve when said housing is mounted into engagement with the upper flange of the valve;

a gas connection having an opening terminating in a central hole in said housing, said central hole extending vertically upwards in said housing from the gas chamber, said hole being open at its upper end;

a tubular slide disposed in the central hole and movable upwardly and downwardly between upper and lower positions, respectively, by means of a hand grip carried by said housing, said slide opening the valve in the lower position such that the interior of the slide communicates with the liquid of the container and the gas chamber communicates with the gas of the container, a wall of said housing having a first gas channel extending upwardly from the gas chamber to a mouth in the central hole;

said slide having an annular groove which, in the upper position of said slide, lies in communication with said mouth and with the open upper end of said hole via a second gas channel;

said mouth being blocked by said slide in the lower position of said slide.

2. A dispenser head according to claim 1 wherein, to seal the slide, a first sealing ring is carried by the wall of the central hole between the opening of said gas connection and the mouth of said first gas channel, a second sealing ring above the mouth of said first gas channel, said groove in the upper position of said slide extending from a location between said first sealing ring and the mouth of the first gas channel to a location above the second sealing ring for communication with the second gas channel, said groove lying below said first sealing ring in said lower position of said slide.

3. A dispenser head according to claim 1 wherein, to seal the slide, a third sealing ring is arranged in the central hole between the opening of gas connection in said hole and the gas chamber, said slide having a second annular groove above said third sealing ring when said slide lies in said upper slide position, said second groove extending from the gas chamber to the opening of the gas connection in the central hole in the lower slide position.

4. A dispenser head according to claim 3, including a section of said central hole having a greater diameter than a remainder of said central hole and extending from the opening of the gas connection to a location above said third sealing ring.

5. A dispenser head according to claim 1 wherein said first gas channel consists of one through hole which extends upwards from the gas chamber to said mouth in the central hole.

6. A dispenser head according to claim 1 wherein said first gas channel comprises a blind hole which terminates in the gas chamber at an open end thereof and communicates a blind end thereof with said central hole via a transverse hole in the wall of the housing.

7. A dispenser head according to claim 1 wherein said first gas channel comprises a blind hole which terminates in the gas chamber at an open end thereof and communicates at a blind end thereof with said central hole via an annular groove in the wall of the central hole.

8. A dispenser head according to claim 1 wherein said second gas channel is formed by a slot between said slide and said central hole, said slot extending axially from the opening at the upper end of said hole to said first groove in said slide in the upper position of said slide.

9. A dispenser head according to claim 1 wherein said second gas channel comprises at least one longitudinal groove in the wall of said housing containing a central hole and extending axially from the opening at the upper end of said hole to said first groove in said slide in the upper position of said slide.

10. A dispenser head according to claim 1 wherein said second gas channel comprises at least one transverse hole extending from ambient atmosphere through a wall of said housing to a location above said second sealing ring, and below an upper confinement of said first annular groove in the upper slide position.

* * * * *